US005104301A

United States Patent [19]

Brewer

[11] Patent Number: 5,104,301

[45] Date of Patent: Apr. 14, 1992

[54] SUCKER ROD PUMP

[75] Inventor: James R. Brewer, Bakersfield, Calif.

[73] Assignee: Shell Western E&P Inc., Houston, Tex.

[21] Appl. No.: 661,365

[22] Filed: Feb. 27, 1991

[51] Int. Cl.[5] ..... F04B 21/02

[52] U.S. Cl. ..... 417/559; 417/569; 137/527.8

[58] Field of Search ..... 417/559, 448, 449, 450, 417/569, 570; 137/527.8, 512.1

[56] References Cited

U.S. PATENT DOCUMENTS

| | | | |
|---|---|---|---|
| 90,157 | 5/1869 | Devirs | 417/448 |
| 346,206 | 7/1886 | Jensen | 417/559 |
| 1,120,826 | 12/1917 | Ligon | 417/450 |
| 1,353,391 | 9/1920 | Hall | 417/448 |
| 1,866,026 | 7/1932 | Gerken . | |
| 2,263,144 | 11/1941 | Scott | 103/203 |
| 2,363,343 | 11/1949 | Lindgren | 103/203 |
| 2,685,257 | 3/1954 | Goldschmidt | 103/156 |
| 2,812,721 | 11/1957 | Coberly | 103/203 |
| 3,046,904 | 7/1962 | Crow | 103/155 |
| 3,136,256 | 6/1964 | Chenault | 103/46 |
| 4,221,551 | 9/1980 | Rupert | 417/511 |
| 4,375,946 | 3/1983 | Page, Jr. | 417/566 |
| 4,470,775 | 9/1984 | Lonardo | 417/569 |
| 4,502,503 | 3/1985 | Karpenko | 137/527.8 |
| 4,662,831 | 5/1987 | Bennett | 417/430 |
| 4,809,739 | 3/1989 | Scaramucci | 137/527.8 |

*Primary Examiner*—Richard A. Bertsch
*Assistant Examiner*—Peter Korytnyk

[57] ABSTRACT

A subsurface well pump is provided which is resitant to vapor locking. The pump is a reciprocating sucker rod pump which has a top inlet valve which comprises one or more hinged flapper valves.

8 Claims, 1 Drawing Sheet

SUCKER ROD PUMP

FIELD OF THE INVENTION

This invention relates to an improved sucker rod pump.

BACKGROUND OF THE INVENTION

Sucker rod pumps are positive displacement pumps used to pump liquids from wells. These pumps are typically located in the wellbore below the liquid level of the liquid to be pumped. The pump has a barrel within which a piston slides up and down. The piston is moved by a rod which extends to the surface, where it is moved up and down by a surface-located pumping unit. The barrel has an inlet check valve at the bottom of the barrel and an outlet check valve in the piston. Fluids flow from the top of the barrel to a tubing which extends to the surface. When the piston slides down, fluids are forced through the check valve in the piston, with the check valve at the bottom of the barrel sealing off, and not allowing the fluids to be pumped out of the barrel and into the well borehole. When the piston is stroking upward, the check valve on the piston seals, and the fluids within the barrel above the piston are lifted upward. At the same time, the piston draws fluids into the barrel through the inlet check valve. These pumps have proven to be simple and reliable although not without problems. When fluids are being pumped which are near their flash point temperature, they will partially vaporize when they are drawn into the barrel. Any vapor which is drawn into the barrel must be compressed to the pressure of the discharge tubing before the top check valve will open, and fluids will be forced out of the pump. The volume of vapors within the pump can be great enough that the full stroke of the piston will not achieve a sufficient pressure to force the outlet check valve open. When this happens, the pump is in a state referred to as vapor locked. Pumps in service pumping oil which has a considerable amount of light material dissolved in it will be subject to vapor locking. When an oil field is subject to a steam flood, a mixture of oil and condensate near its flashing point is produced which also can vapor lock a pump.

When a pump is vapor locked, it is typically shut down for a period. During this period, vapors will have a chance to escape through check valves, and the pump can cool due to the absence of the heat of compression and frictional heat created by the piston sliding up and down. The vapor lock will eventually break, allowing pumping to be continued. Less patient operators adjust the length of the rod, allowing the piston to bang against the ends of the barrel. This causes the outlet and/or the inlet valve to unseat and break the vapor lock. Neither of these solutions to the problem of vapor locking sucker rod pumps is acceptable.

Pumps have been developed which are less prone to vapor locking, but these pumps each have problems. One such pump is described in U.S. Pat. No. 4,221,551. This pump has two sliding valves, both within a barrel, and above a plunger. When the plunger is moving downward, both valves are in lower positions where the bottom valve (inlet valve) has ports aligned with ports in the barrel providing communication between the well borehole and the pump barrel. The top sliding valve (outlet valve) functions like a check valve, sliding upward when the barrel pressure exceeds the pressure at the bottom of the well string. When slid to its upper position, the top valve has ports which align with ports in the barrel to provide communication between the barrel and the well string. The lower sliding valve (inlet valve) is moved to an upper position, where the ports providing communication between the barrel and the well borehole are not aligned. The lower valve is an inverted cup configuration with inlet ports or sleeves, and shoulder ports on the top to allow fluids to communicate from the lower position of the barrel to the top sliding valve. The lower valve is moved to the upper position by the pressure differential created by flow being forced through shoulder ports. Therein lies the shortcoming of this design. There is no significant flow through these shoulder ports until the pressure within the barrel exceeds the pressure at the bottom of the well string, opening the outlet valve. The bottom valve will therefore not move until the top valve opens. Pressure within the barrel must build as a result of the rising plunger in spite of the inlet valve remaining open. This dictates that the inlet ports must have small flow areas because large ports would result in the plunger forcing flow in and out of the working barrel through the inlet ports without ever achieving a pressure sufficiently high to open the outlet valve. The small size of the inlet ports ensures that flashing will occur when fluids near their bubble points are pumped. The mechanism of closing the inlet valve ensures that a significant portion of the upward stroke of the pump will not be productive due to fluids exiting the barrel through the inlet valve ports. This design therefore has many shortcomings.

Another sucker rod pump design which is said to prevent vapor locking is described in U.S. Pat. No. 3,046,904. This design again has inlet and outlet valves above a plunger. This pump utilizes about 24 small ball check valves as inlet valves, all located in an inlet shroud around the top of the working barrel. The small inlet check- valves of this design, again, assure that some flashing will occur when fluids near their bubble points are pumped. Further, if sufficient vapors get into the pump barrel, the pump will, in fact, vapor lock. There is no mechanism to release vapors from the barrel other than to compress them and force them up the well string. If the plunger stroke does not compress vapors within the barrel to the pressure of the bottom of the well string, the pump will vapor lock. This design therefore does not solve the problem of preventing vapor lock of sucker rod pumps.

Another subsurface pump which is said to avoid vapor locking in described in U.S. Pat. No. 3,136,256. The pump avoids vapor lock by lifting a standing valve ball (intake valve) near the top of the intake stroke of the pump. This design has the inlet valve in the typical bottom position. What is vented is therefore the volume which is least likely to have a large amount of vapor. The timing of the opening of the valve is also undesirable. Opening the valve at the end of the inlet stroke almost ensures that the stroke will not result in fluids being pumped up the well string. It also vents the barrel at the lowest possible barrel pressure. At this pressure it is likely that there will be very little driving force to expel compressed vapors. It is unlikely that venting the barrel at this point in the pumping stroke will even break a vapor lock because breaking the vapor lock not only requires that the excess pressure be vented, but that liquids flow into the barrel to be pumped on the downstroke. Both venting the barrel and filling a significant portion of the barrel with pumpable fluids is not likely to be achieved by merely opening the inlet valve at the top of the inlet stroke.

It is therefore an object of the present invention to provide a deep well pump which is capable of pumping volatile fluids and is resistant to vapor locking. It is a further object of the present invention to provide a deep well pump which is of a simple design with relatively few moving parts and relatively few sealing surfaces. It is a further object to provide a deep well pump having one or more inlet valves which has a very low pressure drop through the inlet valve. It is another object of this invention to provide a deep well pump which will not fluid pound.

SUMMARY OF THE INVENTION

The objectives of the present invention are achieved by providing a subsurface well pump, the pump comprising:

- a working barrel which defines a vertical hollow cylinder;
- a plunger which reciprocates along the vertical axis of the working barrel from a lop position to a bottom position;
- a rod connected to the plunger and extending to a means for providing reciprocating force;
- a well string extending from the top end of the working barrel to the surface;
- an outlet check valve which permits flow to exit the working barrel into the well string and does not permit flow to exit the well string into the working barrel; and
- an inlet check valve which permits fluids to flow from outside of the working barrel into the working barrel, the inlet check valve being above the top position of the plunger, the inlet check valve having a cross sectional area of flow about equal to or greater than the horizontal cross sectional area of the working barrel, and the inlet check valve being a hinged flapper valve.

The pump of this invention will be resistant to vapor locking, and allows vapors accumulated in the top of the barrel to escape. The "dead volume", or the volume of compressed fluids between the outlet check valve and the plunger at its uppermost position, is also minimized by this design. This increases the pressure which is attained by the reciprocating pump when the working cylinder is partially filled with vapors.

DETAILED DESCRIPTION OF THE INVENTION

Figure 1:
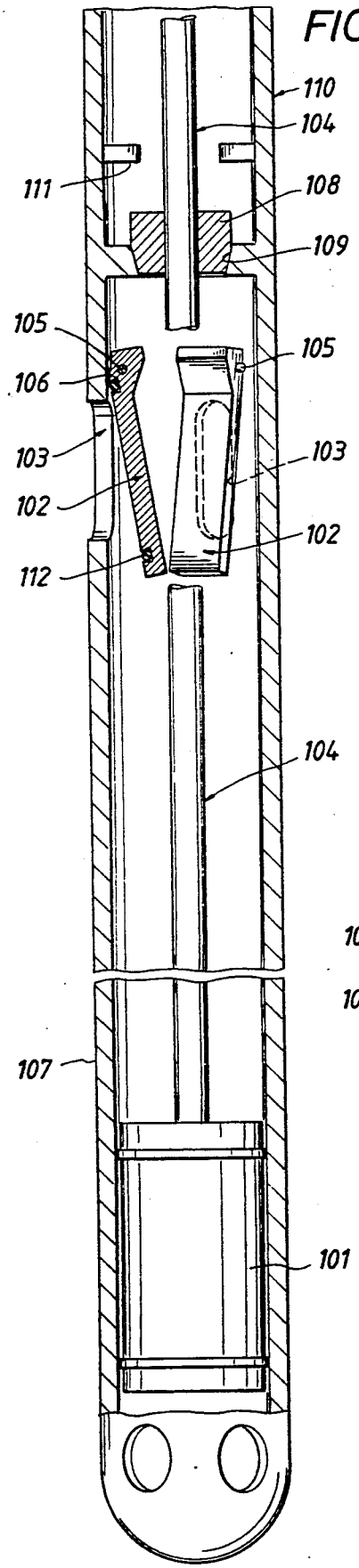
FIG. 1 is a vertical cross sectional view of the sucker rod pump of this invention with a plunger in a lowermost position.

FIG. 1 shows a sucker rod pump of the present invention in which a plunger, 101, is in the lowermost position. In this position, inlet valves, 102, are open allowing the downstroke of the plunger to draw well fluids through inlet valve ports, 103.

As the plunger, 101, is pulled upward by the rod, 104, fluids within the working barrel, 107, are forced out of the working barrel through an outlet valve, 108. Differential pressure between the working barrel and the well borehole forces the hinged inlet valve shut during this upward stroke. The outlet valve shown slides freely over the rod, 104, but seals against the rod. The outlet valve rests on an outlet valve seat, 109, when in the closed position, preventing flow from backing down the well string, 110, into the working barrel, 107. When the plunger is moving upward, fluids within the working barrel force the outlet valve upward and against a retaining cage, 111. The inlet valves are hinged on hinge pins, 105, and freely swing from a position sealing the inlet port to a position away from the inlet port by differential pressure between the well borehole and the working barrel, 107. During the downward stroke, the pressure outside of the inlet valve ports (in the well borehole) is less than the pressure in the well string, 110, above the outlet valve, 108. The outlet valve, 108, will therefore settle onto the outlet valve seat 109, and the inlet valve will open, uncovering the inlet ports, 103. The hinged inlet valves permit some escape of trapped vapors if the vapors are near the top of the inlet port, 103.

Figure 2:
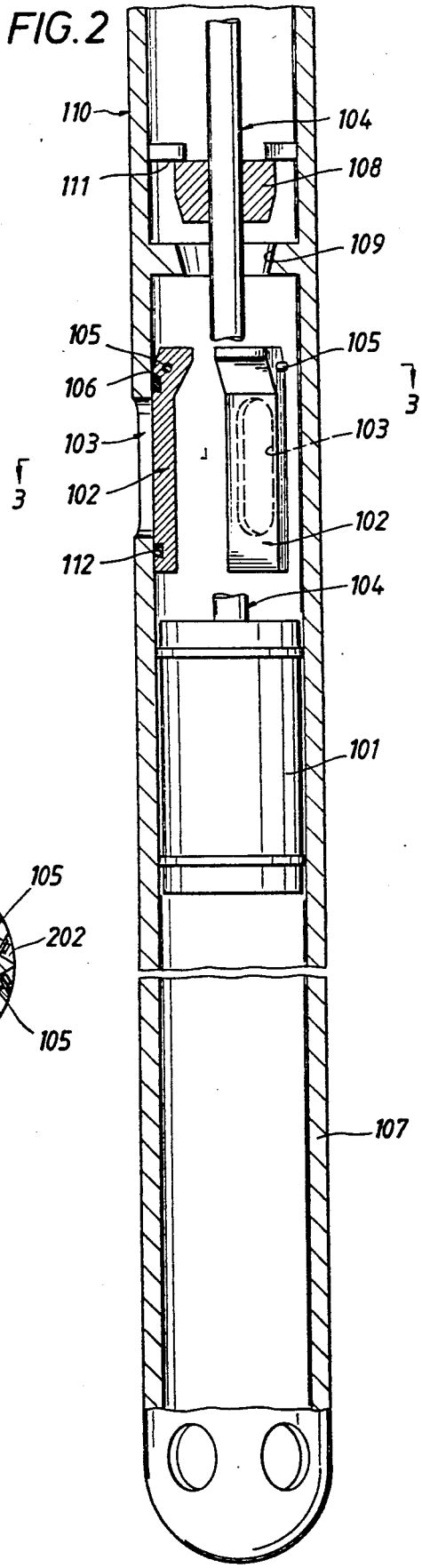
FIG. 2 is a vertical cross sectional view of the sucker rod pump of this invention with a plunger in an uppermost position.
Figure 3:
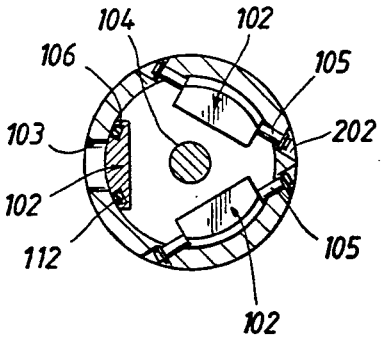
FIG. 3 is a horizontal cross sectional view of the sucker rod pump of this invention.

FIG. 2 shows the same pump with the plunger 101, at its uppermost position. In this position, the plunger forces the contents of the working barrel up the well string in such a way that liquid hammering does not occur. The working barrel will preferably comprise stops (not shown) which prevent the plunger from being pulled up far enough to contact the flapper valves.

The inlet valves are optionally fitted with a seal gasket, shown as an O-ring, 112, within a slot, 106, to provide an improved seal between the valve and the wall of the working barrel.

The location of the inlet ports at the top of the working barrel maximizes the release of vapor-rich working barrel contents when the working barrel contains a minor amount of vapor. The relatively large cross sectional flow area of the inlet valves minimizes the creation of these vapors by minimizing the major source of pressure drop between the borehole and the working barrel. A large inlet port flow area can be provided with this inlet port design due to the use of the side wall of the barrel for ports and seating area.

The pressure drop incurred by drawing fluids through these inlet ports is sufficiently low that vapors accumulated at the top of the working barrel of the pump can escape through the top of the inlet ports as liquid is drawn in through the remaining area of the port. For this to be accomplished, the pressure drop incurred by drawing liquid through the inlet valves must be less than the hydrostatic head of the liquids being pumped over the height of the inlet ports. Thus, a pump such as this allows vapors to escape from the working barrel during the inlet stroke of the pump.

This invention further has the desirable features of permitting a very small volume between the top of the plunger in the upper most position and the outlet valve. Having this volume as small as possible results in maximum compression of any vapors within the working barrel. This pump may be made with the distance from the top of the plunger in the uppermost position 12 inches or less from the bottom of the outlet check valve, and more preferably 8 inches or less. A relatively high fraction of the volume within the working barrel must therefore be vapor in order for the pump to vapor lock.

The pumps of the present invention, due to the location of the inlet valve above the plunger, do not allow fluid pounding, because fluid is being lifted by the plunger, and not forced through a travelling valve in the plunger as in a conventional sucker rod pump.

The only component of this pump which must be specially fabricated is the inlet valve component. The remainder of the pump may be assembled from commercially available components. This feature greatly enhances commercial potential for this improved pump.

What is claimed is:

1. A subsurface well pump comprising:

a) a working barrel;

b) a plunger which reciprocates along the vertical axis within the working barrel between an upper and lower position;

c) a rod connected to the plunger and extending to a means for providing reciprocating force;

d) a well string extending from the top of the working barrel to the surface;

e) an outlet check valve which permits flow to exit the working barrel into the well string and does not permit flow to exit the well string into the working barrel; and f) an inlet check valve which permits flow into the working barrel from outside of the subsurface pump, the inlet check valve being above the top position of the plunger, the inlet check valve having a cross sectional flow area about equal to or greater than the horizontal cross sectional area of the working barrel, and the inlet check valve being a hinged flapper valve.

2. The pump of claim 1 wherein the outlet valve in a sliding ring valve.

3. The pump of claim 1 wherein the flapper comprises a seal ring which contacts the working barrel surrounding the inlet port when the inlet check valve is in the closed position.

4. The pump of claim 3 wherein the seal ring is an O-ring.

5. The pump of claim 1 wherein the distance from the top of the plunger in the uppermost position to the bottom of the outlet valve is about 12 inches or less.

6. The pump of claim 1 wherein the distance from the top of the plunger in the uppermost position to the bottom of the outlet valve is about 8 inches or less.

7. The pump of claim 1 wherein the inlet valve comprises 3 flapper valves.

8. The pump of claim 1 wherein the inlet valve comprises four flapper valves.

* * * * *